United States Patent [19]

Brünig et al.

[11] Patent Number: 4,648,787

[45] Date of Patent: Mar. 10, 1987

[54] APPARATUS FOR TRANSPORTING AND/OR MIXING GASES

[76] Inventors: Matthias A. M. Brünig, Diekbarg 48, D-2000 Hamburg 65; Werner G. Möller, Steendammwisch 53, D-2000 Hamburg 61, both of Fed. Rep. of Germany

[21] Appl. No.: 777,981

[22] PCT Filed: Feb. 20, 1985

[86] PCT No.: PCT/EP85/00057

§ 371 Date: Sep. 11, 1985

§ 102(e) Date: Sep. 11, 1985

[87] PCT Pub. No.: WO85/03745

PCT Pub. Date: Aug. 29, 1985

[30] Foreign Application Priority Data

Feb. 25, 1984 [DE] Fed. Rep. of Germany ..... 3406868

[51] Int. Cl.[4] ..... F04D 1/04

[52] U.S. Cl. ..... 415/72; 415/121 A; 415/219 A; 416/176

[58] Field of Search ..... 415/72, 73, 121 A, 215, 415/219 A, 219 C; 416/176, 177, 188, 179; 98/115.3, 42.02; 366/318, 320, 323

[56] References Cited

U.S. PATENT DOCUMENTS

| | | | |
|---|---|---|---|
| 181,084 | 8/1876 | Long | 416/188 X |
| 2,985,952 | 5/1961 | Nutter et al. | 416/188 X |
| 3,035,781 | 5/1962 | Wallen | 416/176 R |

FOREIGN PATENT DOCUMENTS

| | | | |
|---|---|---|---|
| 704592 | 2/1941 | Fed. Rep. of Germany . | |
| 927920 | 4/1955 | Fed. Rep. of Germany . | |
| 2406458 | 8/1975 | Fed. Rep. of Germany | 98/42.02 |
| 2634496 | 2/1978 | Fed. Rep. of Germany . | |
| 3206772 | 1/1983 | Fed. Rep. of Germany . | |
| 3139997 | 3/1983 | Fed. Rep. of Germany . | |
| 971346 | 1/1951 | France . | |
| 2099907 | 3/1972 | France . | |
| 2408741 | 7/1979 | France | 416/176 |
| 20573 | 3/1929 | Netherlands . | |

OTHER PUBLICATIONS

Product Engineering, vol. 41, Aug. 1970, p. 32.

*Primary Examiner*—Robert E. Garrett
*Assistant Examiner*—Joseph M. Pitko
*Attorney, Agent, or Firm*—Sughrue, Mion, Zinn, Macpeak and Seas

[57] ABSTRACT

An apparatus for transporting gases, liquids and the like by means of a conical screw type propeller 10 which sucks gases or liquids in and passes them along. The propeller consists of at least two guide panels 1, 2 of helicoidal configuration which define apertures 3 in the area of the tips. The propeller may be mounted on a baffle plate 11.

3 Claims, 5 Drawing Figures

APPARATUS FOR TRANSPORTING AND/OR MIXING GASES

BACKGROUND OF THE INVENTION

The invention refers to an apparatus for transporting and/or mixing gases.

There is known a process for the heat rejection from equipment wherein there is made use of the fact that a jet stream directed against a vertical wall will adsorb a multiple of its own volume per time from its ambiency, entrain it and conduct it along the wall. This provides the particular advantage that with a relatively small compressor output for the jet stream there can nevertheless be achieved a relatively great cooling effect.

SUMMARY OF THE INVENTION

The present invention employs this principle, e.g. for mixing methods when different streams (gases, fumes, vapors, liquids capable of dripping, fluids, media and the like) are to be combined, for instance for the smoking of foodstuffs, for the supply of air to a burner, for the removal of gases by suction from a cooking place and the like.

The present invention is also directed to the realization of the flow pattern of a jet stream directed against a wall in a manner different from that known hitherto. This is possible for instance by a conical propeller having outer or inner helical guide panels, rotor blades, or propelling planes. When an air stream emitting from a jet at a certain distance meets a baffle plate standing vertically to the flow, a deflection of this flow will be caused while the air is moving along the baffle surface. It was found that this relatively small air stream (primary flow) will snatch from the ambient region a relatively great secondary flow which at first does not have the flow proceeding along the wall but shows a strong flow velocity component in direction towards the ram point. This fact can now predominantly be used for the mixing of streams of media but it will also be useful to deposit a relatively great amount of heat on the baffle area or to remove it therefrom or to convey air from the interior of a machine or a room, respectively. Particularly significant is also the use for suction hoods in kitchens because here it is possible to suck off a great amount of air and steam with a small, relatively slowly running and silent propeller.

DETAILED DESCRIPTION OF THE PREFERRED EMBODIMENTS

Figure 1:
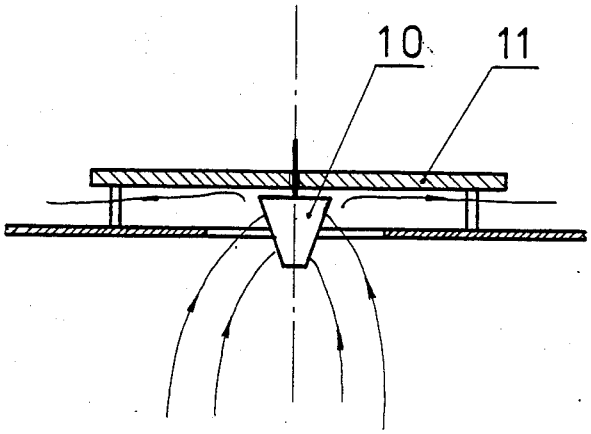
FIG. 1 is a perspective view of an apparatus according to the invention for the removal of gases by suction.

In FIG. 1 is shown an apparatus according to the invention, consisting substantially of a conical propeller 10. The propeller is disposed in an aperture in the wall, a baffleplate 11 being provided above the aperture at a specific distance from the wall surface.

Upon rotating propeller 10, gas will be sucked from the space below the wall face or the baffleplate, respectively, and directed onto the baffleplate 11. From there it is directed outwardly via the space between the wall face and the baffle plate.

In FIG. 1 are indicated the flow lines which reveal that substantial parts of the flow are directly pulled towards the apex point or the axis of propeller 10, respectively.

Figure 2:
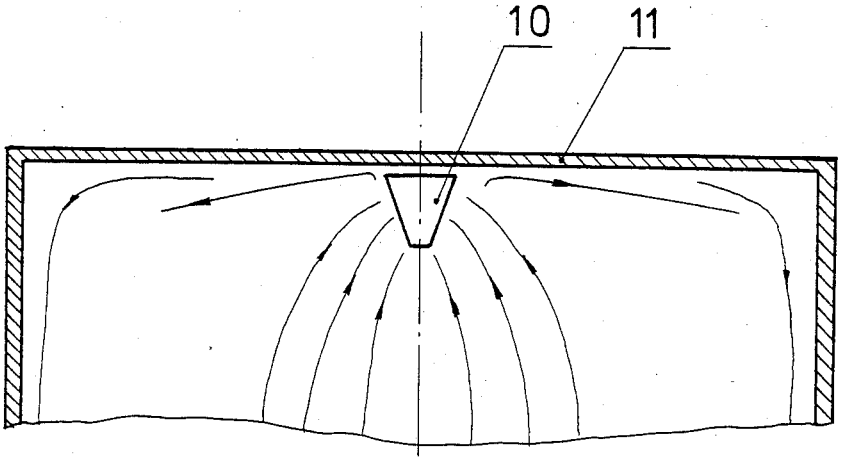
FIG. 2 is a perspective view of an apparatus according to the invention for the circulation and mixing of gases.

In FIG. 2 the propeller 10 is shown directly in front of baffleplate 11, which is simultaneously the wall surface of a room. Also here the flow lines reveal how gas is sucked from the interior of the room and conducted along the wall.

Figure 3:
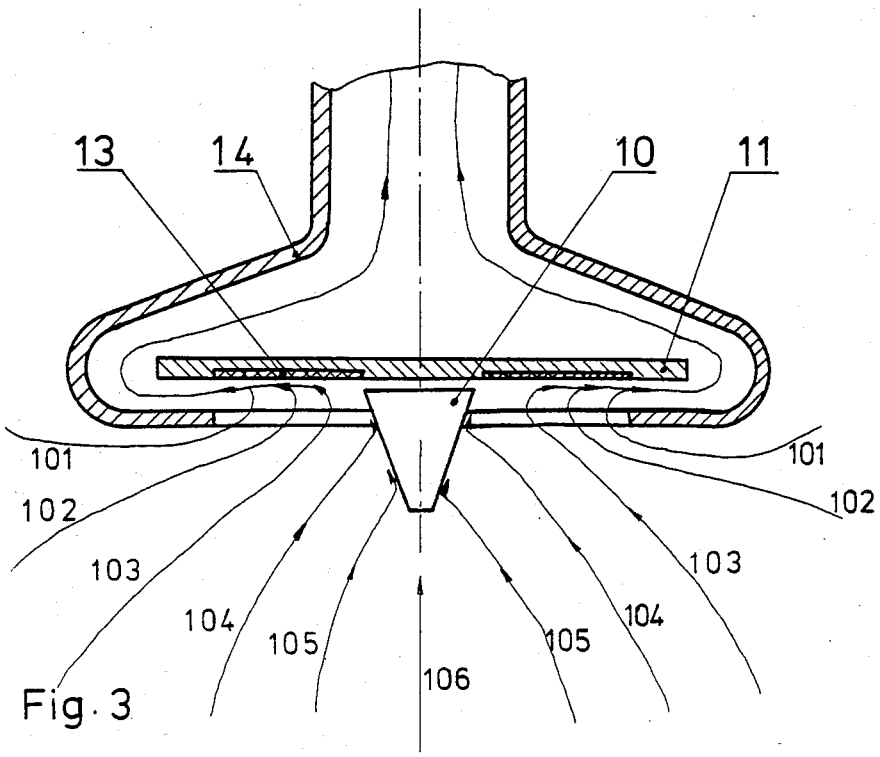
FIG. 3 is a perspective view of the vapor suction hood for cooking sites.

In FIG. 3 is shown the utilization of the apparatus according to the invention in connection with a kitchen vapor exhaust hood.

Again propeller 10 is disposed directly in front of the baffleplate 11. Here there is a stationary surface surrounded by a casing 14. At the lower end the casing 14 is of open design so that vapors and gases can enter through the opening and be carried off upwardly through a chimney or a pipe run. Not shown are the drive means for propeller 10 but it is rotated around its axis.

An exchangeable annular plate 13 is fixed to the baffleplate 11 consisting for instance of an absorbent material. If then the vapors or gases are sucked in by means of propeller 10, any suspended particles in the gas, e.g. fat droplets, dust or the like, will be catapulted onto plate 13 so that an exhaust filter will not be required which would mean a pressure loss in the flow.

In FIG. 3 the reference numerals 101 to 106 illustrate flow lines which could be verified by experimental tests. It is of significance that the flow is present not only in the region of flow line 106 but that gases are sucked in from quite remote regions of the vapor suction hood (region of flow lines 101 to 103). Here there are involved amounts of gases being considerably greater than the amount of the flow in the region of flow line 106. Consequently the suction system can be designed considerably smaller than it was possible hitherto. For instance it is also possible to considerably increase the distance of the suction hood in relation to the cooking place so that a greater head clearance is provided for the cook. Moreover, propeller 10 can operate with a relatively low speed allowing a low-noise suction of vapors.

Figure 5:
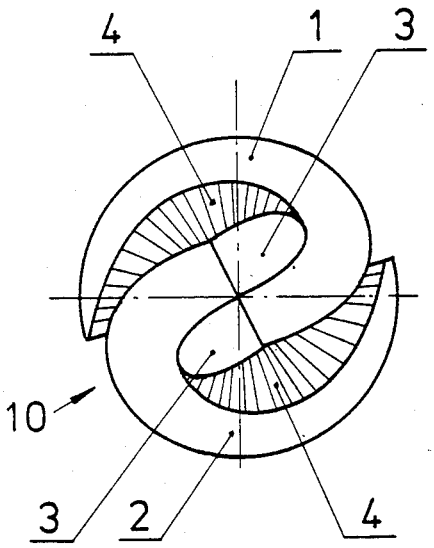
FIG. 5 is an upward view of the propeller shown in FIG. 4.
Figure 4:
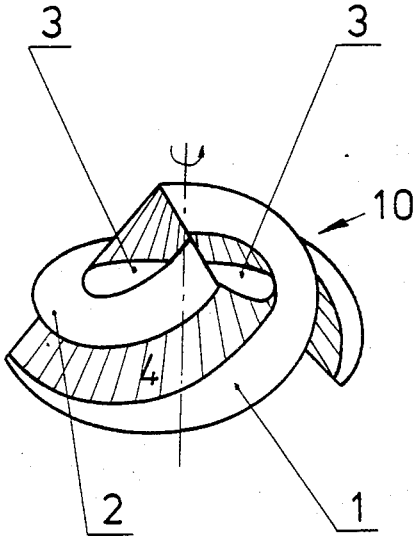
FIG. 4 is a perspective view of a propeller according to the invention.

FIGS. 4 and 5 show an embodiment of the propeller according to the invention. It is a substantially conical structure which is rotated around its axis. The individual joint faces 1, 2, and 4 can be produced of plastic or thin sheet metal and after appropriate shaping attached to one another. Joint face 1 corresponds here to joint face 2 but they are staggered by 180° in respect of one another. The interconnected faces form apertures 3 directed to the axis at about 45°, so that sucked gases can enter through these and be conveyed substantially axially inwardly and discharged at the lower end (FIG. 4). The essential advantage of this propeller is production by an injection molding process without any undercuts and conveyance over the entire propeller-disc area (above the holes as an inner stream, above joint faces 2 as an external stream). The inner stream provides the cooling of the drive motor.

The propelling faces 1 and 2 can in case of suitable arrangement on a cone be produced of soft resilient material (rubber), so that by virtue of the rotation of the propeller and the centrifugal forces developed thereby, they become deformed in a certain manner and allow the desired transport of air. In such case no protective grid for the cone runner is required.

What is claimed is:

1. A fluid transport apparatus, comprising:

(a) a solid baffle plate (11), and (b) a generally conical propeller (10) rotatably mounted closely proximate the baffle plate and axially perpendicular thereto, an apex portion of the propeller being oriented in a direction facing away from the baffle plate, and the propeller comprising:

(1) at least two helicoidal blades (1, 2) equally spaced around a circumference of the propeller and spiralling inwardly towards the apex portion with leading edges of the blades disposed side by side at said apex portion and on opposite sides of the propeller axis, and (2) at least two helical guide panels (4) interconnecting the blades such that the leading edges of the blades are disposed inwardly of the guide panels at the apex portion and trailing edges of the blades are disposed outwardly of the guide panels at an open bottom, base portion of the propeller, the blades and panels thus defining a convolute propeller configuration with a pair of oppositely oriented entry apertures (3) at the apex portion such that fluid is drawn in through the apertures, screw pumped downwardly and outwardly within the propeller toward the base portion, and expelled outwardly therefrom against the baffle plate, the expelled fluid being deflected outwardly by the baffle plate to flow across a surface thereof and transportingly entrain additional fluid surrounding the propeller.

2. An apparatus according to claim 1, wherein the baffle plate comprises a wall of a fluid mixing chamber.

3. An apparatus according to claim 1, wherein the baffle plate and propeller are disposed within an exhaust duct (14), and further comprising a removable annular filter plate (13) mounted to the baffle plate and surrounding the propeller for absorbing particles entrained in the transported fluid, such as dust and grease.

* * * * *